US007567182B2

(12) United States Patent
Faltesek

(10) Patent No.: US 7,567,182 B2
(45) Date of Patent: Jul. 28, 2009

(54) ACOUSTIC FIRE SENSING SYSTEM

(75) Inventor: Anthony E. Faltesek, Roseville, MN (US)

(73) Assignee: Honeywell International Inc., Morristown, NJ (US)

( * ) Notice: Subject to any disclaimer, the term of this patent is extended or adjusted under 35 U.S.C. 154(b) by 742 days.

(21) Appl. No.: 10/859,706

(22) Filed: Jun. 3, 2004

(65) Prior Publication Data

US 2005/0273279 A1 Dec. 8, 2005

(51) Int. Cl.
*G08B 17/12* (2006.01)

(52) U.S. Cl. ..... 340/577; 340/584; 340/540; 702/48; 702/54

(58) Field of Classification Search ..... 340/540, 340/679, 680, 686.1, 603, 606, 577, 584, 340/528; 702/48, 54; 706/8; 367/191
See application file for complete search history.

(56) References Cited

U.S. PATENT DOCUMENTS 4,289,019 A 9/1981 Claytor
4,858,462 A 8/1989 Coulter et al.
5,040,409 A 8/1991 Kiewit
5,175,530 A * 12/1992 Eng ..... 340/606
5,409,037 A 4/1995 Wheeler et al.
5,416,724 A 5/1995 Savic
5,675,506 A 10/1997 Savic
6,215,404 B1 4/2001 Morales
6,453,247 B1 9/2002 Hunaidi
6,873,256 B2 * 3/2005 Lemelson et al. ..... 340/539.1
6,940,409 B1 * 9/2005 Green ..... 340/603
2001/0003286 A1 6/2001 Philippbar et al.
2003/0146843 A1 * 8/2003 Dittmer ..... 340/588
2005/0110632 A1 * 5/2005 Berezowski et al. ..... 340/521

FOREIGN PATENT DOCUMENTS

DE 44 26 911 C2 12/1995
JP 07088209 A 4/1995

* cited by examiner

*Primary Examiner*—Daniel Wu
*Assistant Examiner*—Hongmin Fan
(74) *Attorney, Agent, or Firm*—Husch Blackwell Sanders Welsh & Katz

(57) ABSTRACT

The acoustic sound of water flowing to/from activated sprinkler heads is used to identify fire location in a region(s). Acoustic transducers, such as microphones, can be located in the vicinity of sprinkler heads. Active heads, spraying water, will produce sounds of flowing water to which the transducers respond. Alternately, acoustic flow sensors can be coupled to sprinkler head feed pipes.

6 Claims, 2 Drawing Sheets

ACOUSTIC FIRE SENSING SYSTEM

FIELD OF THE INVENTION

The invention pertains to fire detection and alarm systems. More particularly, the invention pertains to such systems where the sound of water from a sprinkler head is sensed as indicative of a fire condition.

BACKGROUND OF THE INVENTION

Fire fighters need to find the location of a fire or fires as quickly as possible after they arrive at a building. Many fire departments assume that if a fire has not been actively fought within 20 minutes of its inception, the building cannot be saved.

Significant amounts of time can be spent trying to find the location of the fire, even when it is evident that there is a fire. Fire fighters arriving at a scene can often have a difficult time determining whether there is a fire. Even if it is determined that there is a fire, they often have difficulty determining where the fire is located.

Activation of one smoke alarm is an indication that there probably is a fire. Activation of multiple smoke alarms is a much higher probability indication that there is a fire. Activation of a sprinkler system, with resulting water flow usually is a nearly certain indication that there is a fire.

Occasionally a fire department is fortunate enough to pull up at the building and see visible signs such as smoke, or flames. In such cases, they can be certain from the onset that there is a fire and can proceed to searching for victims and the fire location. But these signs may not give any indication of where the fire is located in the building.

Smoke can travel through a building. Active smoke alarms are an indication of where smoke is, but the smoke may have traveled some distance from the fire.

Sprinklers are rarely activated unless they are subjected to the heat of a fire. An operating sprinkler is a very highly reliable indicator of the location of a fire. An operating sprinkler is a certain indicator of ongoing and substantial water damage. Establishing the location of operating sprinklers as quickly as possible is a high priority during an emergency. Increasing the speed with which an operating sprinkler can be located increases fire safety in buildings, and reduces the average overall level of damage by an incident.

Sprinklers make characteristic sounds when they are operating and water is flowing therefrom. Water makes sounds as it travels through the body of the sprinkler, strikes and deflects from the deflector, and as it strikes the ceiling and walls of the space that the sprinkler is mounted in. It is possible that under at least some circumstances, the sound of the water striking walls, the ceiling, and the floor of a space may be the loudest sound created by an active sprinkler.

Flow detectors can be used to determine that sprinklers are activated. Current sprinkler flow detectors do not give information about where individual sprinkler heads are flowing as a large number of sprinkler heads are usually associated with each flow detector.

Flow detectors are usually located, one per floor, at the main feed into the floor. At times they are installed less frequently. They are often not used due to facility management cost savings goals, limited code requirements and also due to operational issues associated with maintenance.

Flow detectors are generally difficult to maintain because they gunk up and corrode over time. Even a building that does frequent flow tests on its sprinkler system may find that there is a limited life for the flow detectors.

There is thus a continuing need for improved sensing systems which use, in some way, activated sprinkler heads as indicators of fire location. Preferably such results will be achievable without having to redesign the sprinkler heads. Additionally, it would be preferable if such flow sensing capability could be retrofitted in existing sprinkler systems.

DETAILED DESCRIPTION OF THE EMBODIMENTS

Figure 1:
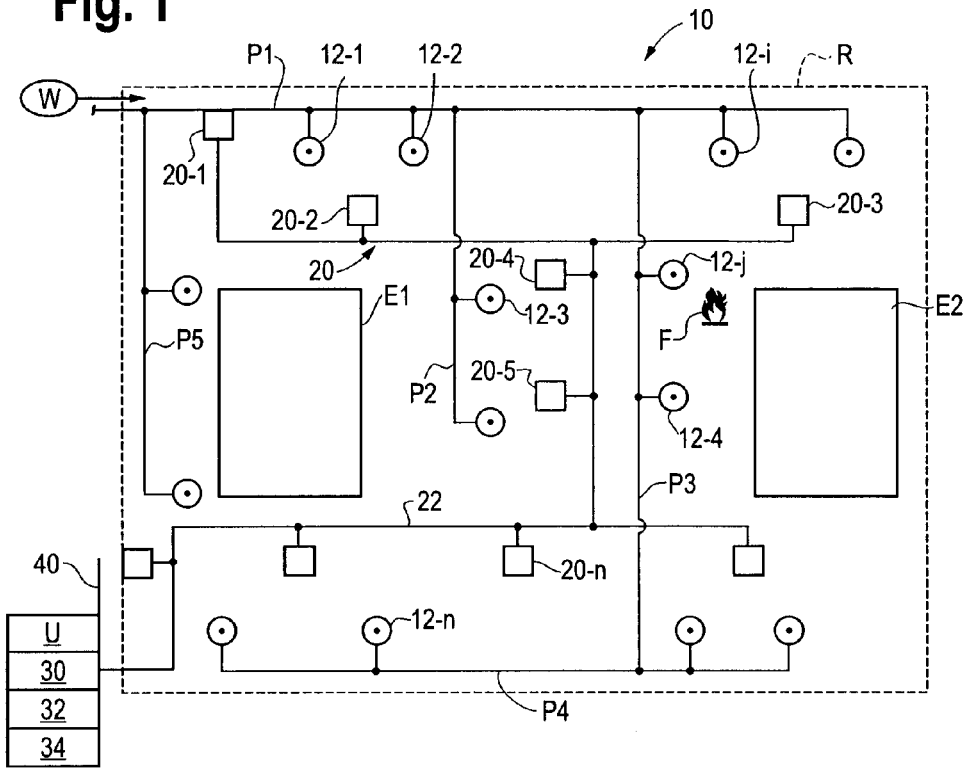
FIG. 1 is a top plan view of a region being monitored by a system which embodies the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

A system that embodies the invention senses the acoustical signature of water flowing in one or more sprinkler feed pipes, and identifies where water is flowing from sprinkler heads in order to identify the location of flames. Acoustical sensors could be attached to the outside of the sprinkler pipes. The signals could be processed at a central location that could interpret the location and size of the fire from the information about which sprinkler heads are flowing.

Those of skill in the art will understand that one of the most reliable potential ways to determine the location of a fire is to be able to accurately know where sprinkler flow is located at a resolution of groups of about 5 to 20 heads. Acoustical sensors could be a cost effective, simple, robust and easily retrofitted way to sense flow at this more localized level.

Sensors could be tuned to the frequency associated with the diameter of a selected pipe to which a respective sensor is to be coupled. The signals from these sensors could be routed to an acoustic sprinkler flow module in the fire protection system for processing and annunciation.

In an alternate embodiment, a plurality of acoustic transducers could be located in the vicinity of various sprinkler heads. The transducers could respond to water spraying from the heads, activated by a fire. Signals from the transducers, microphones for example, could be coupled to a local fire alarm or regional monitoring system. The received signals would be indicative of the location of a fire in the region being monitored.

The chances of false positive alarms should be very low in systems which embody the invention. Sprinkler feed pipes would normally not produce the characteristic acoustic signature without water flowing. Acoustic sensor alarms could be confirmed with smoke sensor alarms. At least one activated flow switch alarm could verify water is flowing in the sprinkler system and would confirm the acoustical sensor alarm.

Information pertaining to received acoustic alarms could be displayed for fire fighting personnel at a system control panel. Fire fighting personnel would benefit from a user interface that would display large-scale information as to which zone or section has alarms, as well as detailed information about a room or region that has alarms.

One embodiment of the invention includes a processing unit which would identify the area of the building where the water is flowing. The processing unit would have the building floor plan in its database. Acoustical sensor locations could be mapped to the plan. Each area that is downstream of a sensor location would be mapped out on the plan.

When a sensor detects flowing water, the processing system would display the area where water is spraying. While the zone downstream of the sensor might have up to 10 or 12 sprinkler heads, as few as one might be flowing. But the area where a flowing head would be located will be displayed by the system. Such areas could be designed to be small enough for fire fighters to search quickly.

Where the sensors are configured to respond to the sound of spray from an activated head(s) the display could illuminate the one or more responding sensors of interest.

A method which embodies the invention detects the airborne sounds of active sprinklers. The detector(s) could be implemented using audio transducers mounted in the building. Alternatively, the detectors or listening devices could be mounted in multi-sensor smoke or fire detectors, or in combination with any other types of equipment.

Algorithms to accurately compare the sounds that are detected to stored sound signatures of water spraying from sprinkler heads could be used to achieve recognition of spraying sounds. Acoustic detectors could be calibrated to assure that sounds were being heard accurately. A library of sprinkler sound signatures could be stored and used to assure that the many permutations and combinations of sound could be analyzed accurately.

The many different types of sprinkler heads and the different sounds sprayed water can make when striking different types of building materials need to be accounted for in the sound signature library. Once a sound sample has been picked up by a detector or detectors, processed and recognized as eminating from an active sprinkler in the region, a signal could be sent to a control system and user interface that would provide an alarm or alert and could illustrate for a user where the active sprinkler head is located.

FIG. 1 illustrates a top-plan view of a region R which is being monitored by a system 10 in accordance with the invention. The system 10 includes a plurality of sprinkler heads, such as exemplary heads 12-1, -2, -3, -4 . . . *-n* without limitation. The sprinkler heads 12-1 . . . *-n* are scattered throughout the region R based on the internal structure of the region which includes interior walls, offices, elevators/stairwells such as E1, E2 and the like. Those of skill will understand the types of sprinkler head patterns which are used to cover various arbitrary areas or regions such as the region R. It will also be understood that the region R could include a single level, as illustrated in FIG. 1 or, include a plurality of levels or sections displaced vertically relative to one another, all without departing from the spirit and scope of the present invention.

In the exemplary embodiment of FIG. 1, the region R includes a plurality of pipes, such as pipes P1, P2, P3, P4, P5, . . . PN, all without limitation, for providing fluid or water W from a reservoir to the plurality of sprinkler heads 12-1 . . . *-n* scattered throughout the region R. As those of skill will understand, if a thermal event or a fire should commence in the vicinity of one or more of the sprinkler heads, such as exemplary heads **12-*i*, 12-*j* such adjacent heads might respond to the presence of the event or fire by going from a no-flow, inactive, state to a full-flow, active, state fed by fluid or Water by the respective pipes such as P1, P2, P3. In such event, fire suppressing fluid or water W would be sprayed from the respective active heads, such as 12-*i***, *-j* into the adjacent portion of the region R for fire or flame suppression purposes.

In accordance with the present invention, the system 10 incorporates a plurality of acoustic sensors or transducers, for example, microphones, 20-1, -2, -3, -4, -5 . . . *-n*. The transducers **20*i*, it will be understood, can be implemented with any technology which will convert acoustic sounds of water spraying from one or more active heads, such as 12-*i***, *-j* in response to the presence of a thermal or fire event, into respective electrical signals.

In the representative region R the fire or thermal event which might activate heads **12-*i***, *-j* would in turn result in acoustic sounds of water flowing therefrom into portions of the region R adjacent thereto. Acoustic sensors, such as sensors 20-2, -3, -4, -5 could be expected depending on the size shape and layout of the region R to pick up or detect the acoustic sounds of the fluid or water flowing from the respective activated head and produce one or more electrical signals indicative thereof.

The plurality of acoustic detectors 20 could be coupled by a communications link, such as via a cable 22, or alternately wirelessly, all without limitation, to a regional monitoring unit such as a fire or gas monitoring apparatus U. The unit U could include a programmed processor 30 as well as appropriate interface circuits 32 enabling the processor 30 to communicate either via cables 22 or wirelessly with the acoustic detectors 20 scattered throughout the region R. The unit U could also incorporate storage 34 which could include control/communication programs all without limitation as well as one or more databases and/or acoustic signatures indicative of the types of sounds made by fluid or water W flowing from active sprinkler heads such as **12-*i***, *-j*

The unit U can also incorporate one or more display devices 40 which can present images indicative of one or more portions of the region R wherein a sprinkler heads such as **12-*i***, *-j* have become activated. Such displays could be used by building personnel or first responders for purposes of identifying one or more activated sprinkler heads, such as **12-*i***, *-j* as well as illustrating the portion of the region R where the activated sprinkler heads are located. Such information would be useful to first responders for example, who might approach the fire event F and not from stairwells associated with column E2 but rather from stairwells associated with column E1 for safety's sake. Further, this information would make it possible for first responders to quickly identify those portions of the region R which should be searched for individuals who might be trapped by the fire or thermal event F It will also be understood that the acoustic sensors such as 20-1 . . . **20-*n* could be either stand-alone units, or could be incorporated into other units such as ambient condition detectors including smoke detectors, flame detectors, gas detectors, thermal detectors, all without limitation. In such event, the communications link 22**, wired or wireless, could be configured as a bi-directional link such that the unit U could communicate with the respective detector or detectors as well as receive signals from the respective acoustic sensor.

Figure 2:
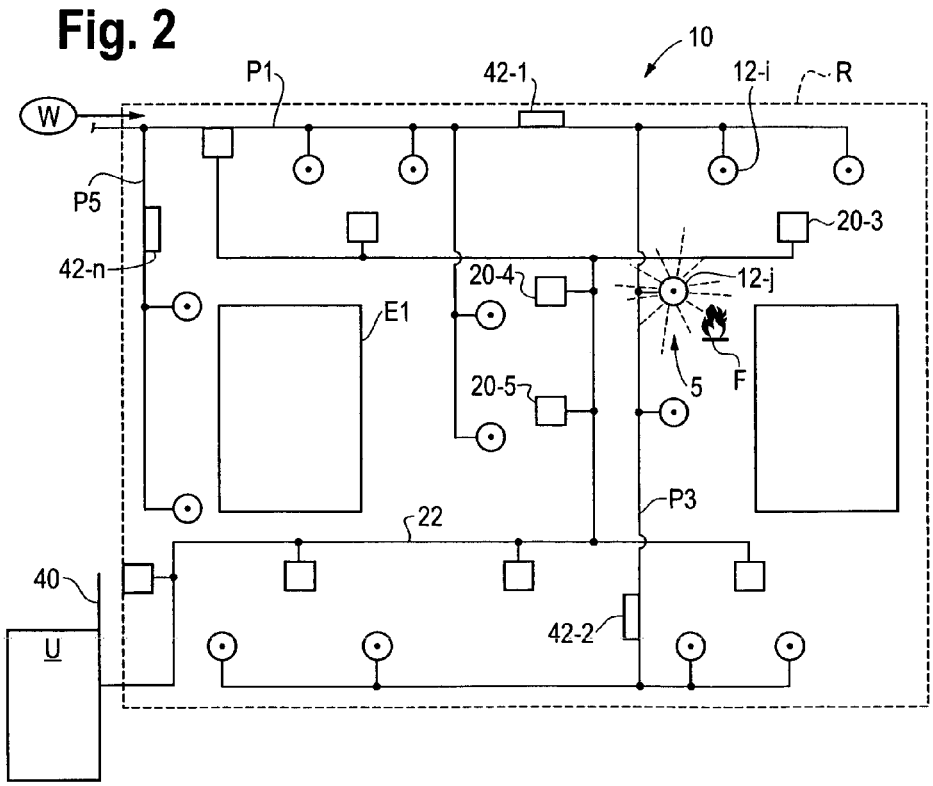
FIG. 2 is a top plan view, as in FIG. 1 with an active sprinkler head.

FIG. 2 illustrates the system 10 with sprinkler head **12-*j* having been activated by thermal or flame event F. In such event, the head 12-*j* would be spraying water, indicated generally at S for purposes of suppression of the flame event. As discussed above, the acoustic sounds produced by the spray could be detected by acoustic sensors 20-3, -4 as well as others in the area such as 20-5**.

Signals from the sensors such as 20-3, -4, and -5 upon being coupled by communication media 22 to unit U could in turn be analyzed, perhaps using pre-stored audio signatures from the database 34 to establish that head 12-*j* had in fact gone into an active state and was spraying suppressing fluid. Activation of other heads in the area could be established similarly. All such information could be presented on display 40 for the use of building personnel or first responders.

In the event that the acoustic detectors 20-3, -4, -5 were incorporated into one or more ambient condition detectors the presence of the thermal or flame event F could be confirmed not only by the activation of the head 12-*j* but by signals received at unit U from the respective detectors indicative of smoke, fire, gas, increased temperature and the like, so as to minimize the likelihood of false alarms from the unit U.

Further confirmation could be provided by one or more conduit mounted flow detectors 42-1, -2 . . . -*n*. The detectors 42-1, -2 . . . -*n* respond to fluid flowing in the respective adjacent pipes such as P1, P3 or P5, as an alternate to the sensing of the audible indicia generated by the spray S. Signals from the detectors 42-1, -2 . . . -*n* could be coupled by one or more communication links to the unit U to provide additional confirmation of the presence of a thermal or flame event F.

In the illustrated embodiment of FIG. 2, flow detector 42-1 could be expected to provide a signal indicative of the flow of fluid in the pipe P1. Depending on the number of flow detectors 42-1, a pre-determined level of specificity could be arrived at as to which pipe or pipes was exhibiting fluid flowing therein.

It will be understood that the exact nature of the flow detectors 42-*i* are not limitations of the present invention. They could for example be based on a mechanical technology, such as water pushing a vane and in turn closing a switch, or alternately some form of non-contact sensing could be used all without limitation.

Those flow detectors 42*i* which have been activated by head 12-*j* could be presented graphically on display 40 alone, or in combination with the acoustic detectors 20-*i* which are exhibiting an acoustic output indicative of the presence of the spray S. Such information could also be used by first responders to more specifically identify the location of active heads, such as 12-*j*.

Figure 3:
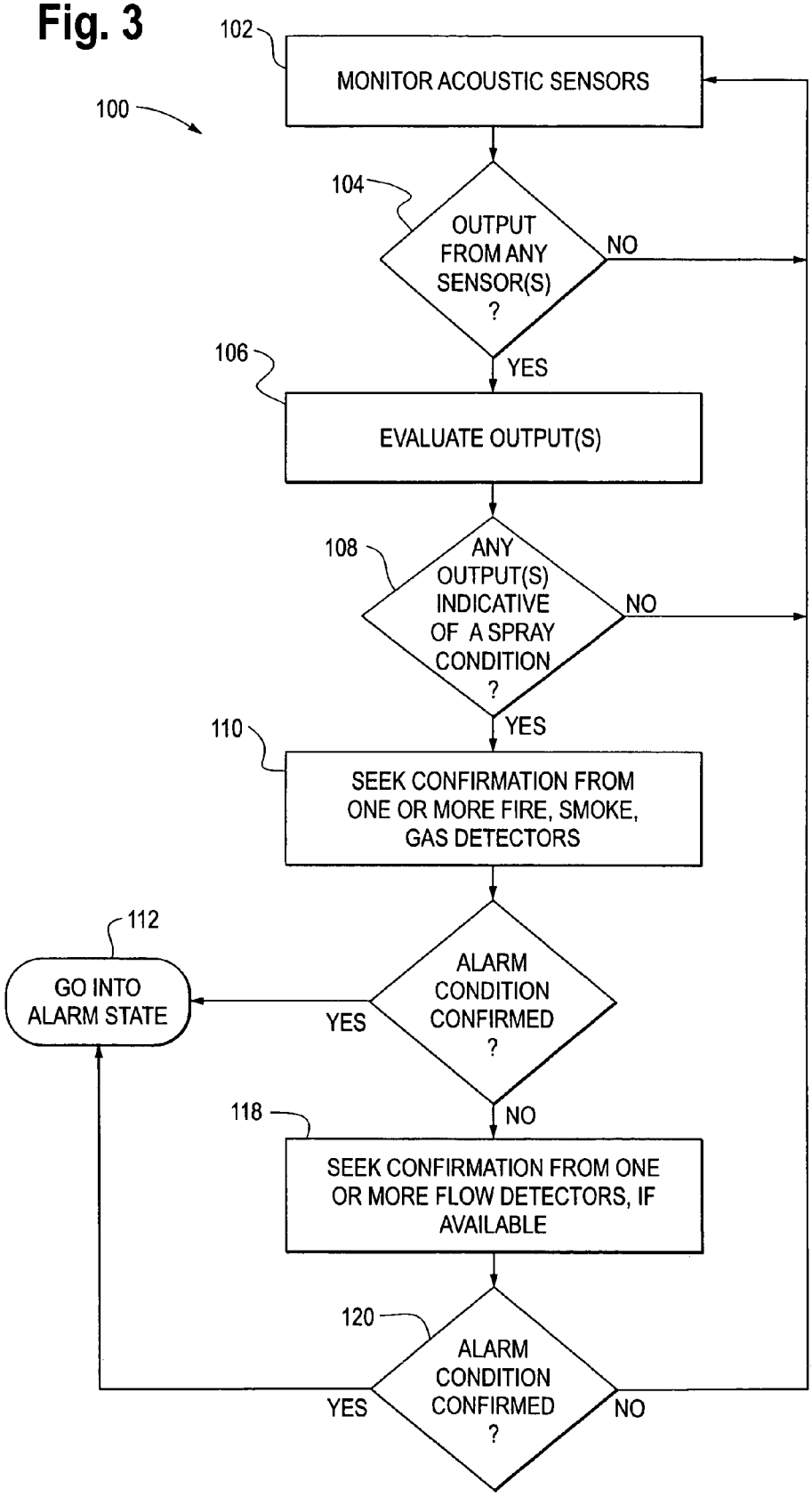
FIG. 3 is a flow diagram of a method in accordance with the invention.

FIG. 3 illustrates an exemplary method 100 in accordance with the present invention. In an initial step 102, outputs from the acoustic sensors such as 20-1, -2 . . . -*n* are monitored. Sensed outputs, step 104, are evaluated in step 106. A determination is made in step 108 as to whether any of the outputs are indicative of a spray condition. If so, in step 110, confirmation is sought from one or more ambient condition detectors in the area such as fire, smoke or gas detectors.

In the event that an alarm condition is confirmed, an alarm can be indicated, step 112. If not, confirmation could alternately be sought from one or more flow detectors, such as flow detectors 42-1, -2 . . . -*n* if available, step 118. If an alarm condition is confirmed step 120 an alarm can be generated. Otherwise, the monitoring process continues, step 102.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detection method comprising:

sensing heat at a plurality of spaced apart heat sensing locations in a region being monitored;

responsive to sensed heat at a particular location, initiating fluid flow through a plurality of pipes for fire suppression at the location;

establishing a second plurality of spaced apart acoustic sensing locations in the region with each sensing location displaced from the heat sensing locations;

generating an acoustic signature of water spraying from an active sprinkler at the particular location and broadcasting that acoustic signature into the region;

sensing the acoustic signature being broadcast simultaneously at two or more members of the second plurality of acoustic sensing locations;

transmitting, outside of the plurality of pipes, an indicator of the sensed acoustic signature from each of the two or more members of the plurality of acoustic sensing locations to a common location and displaying the location of the acoustically sensed fluid flow at the common location.

2. A detection method as in claim 1 which includes sensing smoke at a third plurality of spaced apart smoke sensing locations in a region being monitored where at least some of the acoustic sensing locations correspond to least some of the smoke sensing locations and where both the indicator of the sensed acoustic signature and an indicator of sensed smoke from all such locations are transmitted outside of the plurality of pipes to the common location.

3. An apparatus for sensing and suppressing fire in a region being monitored comprising:

a plurality of interconnected pipes located in the region, for delivery of fire suppression fluid;

a plurality of sprinkler heads with each head connected to a pipe;

a plurality of smoke detectors located in the region, with the smoke detectors displaced from the sprinkler heads and not connected to the pipes, the smoke detectors are electrically coupled to a common control unit;

a plurality of microphones located in the region with the microphones displaced from the sprinkler heads and not connected to the pipes, where the microphones are all electrically coupled to the common control unit and where the control unit receives signals from at least one of the smoke detectors, indicative of sensed smoke, and at least one of the microphones, indicative of an acoustic signature of water spraying from an active sprinkler head in the region, and responsive thereto establishes the presence of an alarm condition.

4. An apparatus as in claim 3 which includes a water flow sensor attached to one of the pipes, the water flow sensor is electrically coupled to the common control unit and the control unit, responsive to a flow indicating electrical signal, confirms the presents of the alarm condition.

5. An apparatus as in claim 4 where at least some of the smoke detectors each include a microphone from the plurality of microphones.

6. An apparatus as in claim 3 where at least some of the smoke detectors each include a microphone from the plurality of microphones.

* * * * *